United States Patent [19]

Aronson

[11] Patent Number: 4,939,794

[45] Date of Patent: Jul. 10, 1990

[54] ADJUSTABLE NECK AND CUFF CLOSURES FOR DRESS SHIRTS

[75] Inventor: Herbert R. Aronson, New York, N.Y.

[73] Assignee: Salant Corporation, New York, N.Y.

[21] Appl. No.: 275,961

[22] Filed: Nov. 25, 1988

[51] Int. Cl.[5] ..... A41B 3/00; A41B 7/00; A41F 1/00

[52] U.S. Cl. ..... 2/128; 2/60; 2/123; 2/141 R; 2/265; 2/115

[58] Field of Search ..... 2/60, 141 R, 141 A, 2/123, 128, 135, 136, 137, 115, 265

[56] References Cited

U.S. PATENT DOCUMENTS

| | | | |
|---|---|---|---|
| 2,523,175 | 9/1950 | Yates | 2/128 |
| 3,142,843 | 8/1964 | Berger | 2/265 |
| 3,311,926 | 4/1967 | Gerber | 2/128 |
| 3,394,437 | 7/1968 | Sinclair | 2/265 |
| 3,889,297 | 6/1975 | Jarboe et al. | 2/123 X |
| 4,628,545 | 12/1986 | Metzler | 2/265 |

FOREIGN PATENT DOCUMENTS

| | | | |
|---|---|---|---|
| 6608991 | 12/1967 | Netherlands | 2/DIG. 6 |
| 878809 | 10/1961 | United Kingdom | 2/DIG. 6 |

OTHER PUBLICATIONS

Maurice Gershman, "Self-Adhering Nylon Tapes", from the J.A.M.A., vol. 168, No. 7, Oct./1958, p. 930.

*VELCRO Brand Tape Fasteners,* (1972 in Sep. and prior to 9-26-77).

*Primary Examiner*—Werner H. Schroeder
*Assistant Examiner*—Jeanette E. Chapman
*Attorney, Agent, or Firm*—Darby & Darby

[57] ABSTRACT

The neck and/or cuffs of a man's dress shirt are closed in a continuous adjsutable manner by providing Velcro-type fasteners on respective facing portions of the garment. A dress button sewn on an outer surface of a dress shirt portion simulates the appearance of a conventional garment closure button but serves no part in fastening outer and inner garment portions together.

5 Claims, 2 Drawing Sheets

ADJUSTABLE NECK AND CUFF CLOSURES FOR DRESS SHIRTS

BACKGROUND OF THE INVENTION

1. Field of the Invention

This invention generally relates to dress shirts and, more particularly, to adjustable neck and cuff closures for men's dress shirts.

2. Description of Related Art

A conventional man's dress shirt has a buttonhole formed in one end region of a neck band, and a neck closure button sewn on an outer surface of an opposite end region of the neck band. The neck closure button is passed through the neck buttonhole to fasten overlapping end regions of the neck band to each other.

Analogously, in a long-sleeved shirt, a buttonhole is formed in one end region of a cuff, and a cuff closure button is sewn on an outer surface of an opposite end region of the cuff. The cuff closure button is passed through the cuff buttonhole to fasten overlapping end regions of the cuff to each other. After fastening, the neck and cuff closure buttons face outwardly away from the wearer of the shirt to present a neat attractive appearance to others.

It is often desirable to adjust the amount of overlap of the neck band and each cuff to accommodate differently sized necks and wrists of different wearers, or to accommodate a wearer experiencing a change in size. For the neck closure, it has been proposed to attach to the shirt a loop accessory for engaging the neck button. The loop accessory serves as a substitute for the neck buttonhole and allows the neck closure button to be fastened at a further distance from the neck buttonhole. The loop accessory detracts from one's appearance, so much so that it is often only used in conjunction with a tie whose knot conceals the loop accessory. Nevertheless, if the tie knot is small in size or if the tie knot shifts, the loop accessory will come into view, thereby detracting from the wearer's appearance.

As for providing adjustability for the cuff closure, some manufacturers have resorted to providing two cuff buttons spaced apart in a circumferential direction about the cuff. The wearer can select which button to pass through the cuff buttonhole, thereby achieving a limited measure of adjustability. Should the wearer select the first button to fasten the cuff, then the second button will remain exposed, thereby again detracting from the wearer's appearance.

SUMMARY OF THE INVENTION

1. Objects of the Invention

It is a general object of this invention to overcome the aforementioned drawbacks of the prior art.

It is another object of this invention to enable a wearer of a garment, particularly a shirt, to adjust, in a continuous, infinitely variable manner, the extent of overlap of overlapping neck and/or cuff portions.

Another object of this invention is to eliminate unsightly double cuff buttons and neck loop accessories.

A further object of this invention is to reliably fasten neck and/or cuff portions by pressing the respective overlapping portions together.

Still another object of this invention is to provide continuously adjustable neck and/or cuff closures without compromising the appearance of the garment.

Yet another object of this invention is to simulate the appearance of a garment, particularly a dress shirt, by providing a dress button at the neck and cuffs of the garment, but which dress button is not responsible for fastening the neck and/or cuff portions.

2. Features of the Invention

In keeping with these objects, and others which will become apparent hereinafter, one feature of this invention resides, briefly stated, in an adjustable closure for overlapping portions of a garment. In a preferred embodiment, the garment is a dress shirt, particularly a man's dress shirt, and the garment portions to be overlapped are the neck band and/or each cuff.

The adjustable closure includes closure means for continuously adjustably overlapping and fastening an outer garment portion over and to an inner garment portion. The closure means includes a first soft, flexible fabric sewn on an inner surface of the outer garment portion, and having first fastening means extending lengthwise along the first fabric. The closure means also includes a second soft, flexible fabric sewn on an outer surface of the inner garment portion, and having second fastening means extending lengthwise along the second fabric. The first and second fastening means face and engage each other when the outer garment portion overlaps the inner garment portion to a desired infinitely variable extent selected by a wearer, and is pressed against the inner garment portion. The first and second fastening means are disengaged from each other when the outer garment portion is peelably removed from the inner garment portion.

The closure further includes a dress button sewn on an outer surface of the outer garment portion. The dress button is a "fake" in the sense that it simulates the appearance of a conventional garment closure button used for fastening outer and inner garment portions together. The dress button of this invention constitutes no part of the closure means, the latter being solely responsible for fastening the outer and inner garment portions together. The dress button is strictly decorative.

In a preferred embodiment, the first fastening means constitutes a multitude of hooks, and the second fastening means constitutes a multitude of loops. The hooks hookingly engage the loops when the outer garment portion is pressed against the inner garment portion. The hooks are disengaged from the loops when the outer garment portion is pulled away from the inner garment portion. Advantageously, this hook-loop construction is achieved by Velcro (trademark) materials.

Thus, the wearer of the garment equipped with the above-described adjustable closure has the capability of adjusting the extent of overlapping neck and/or cuff portions in a continuous, infinitely variable manner. Double cuff buttons and neck loop accessories have been eliminated. No longer need the garment wearer pass conventional neck and cuff closure buttons through neck and cuff buttonholes. The outer appearance of the garment in the neck and cuff regions is even more attractive than before because the presence of the buttonhole itself at the neck and cuffs of the garment can be eliminated.

This invention, although described mainly in connection with men's dress shirts, is equally well applicable to women's dresses, blouses, pants or slacks, scarves, sweaters, coats, footwear, gloves, and virtually any other garment worn by man or animal having overlapping garment portions which are desired to be adjustably closed.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

DETAILED DESCRIPTION OF THE PREFERRED EMBODIMENTS

Figure 1:
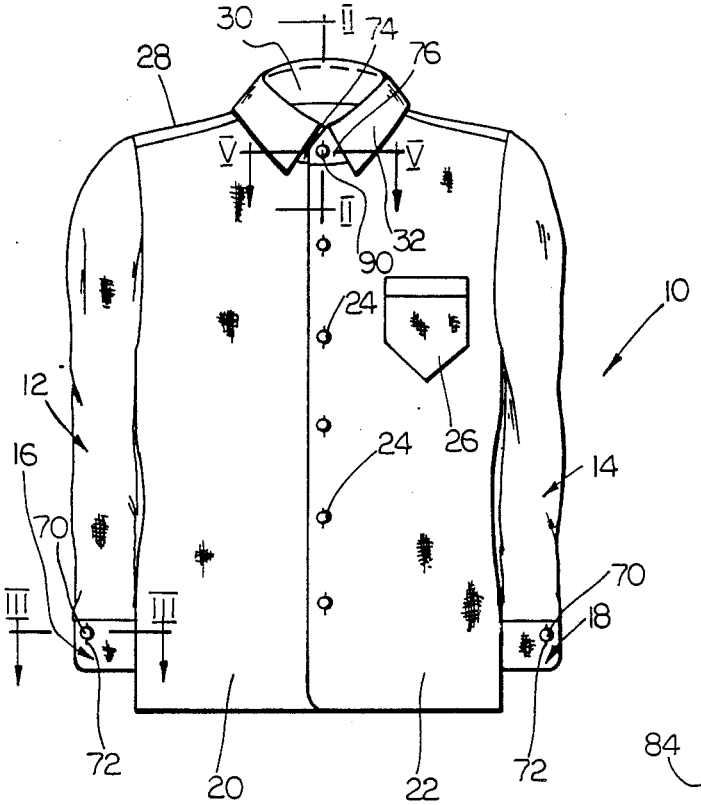
FIG. 1 is a front view of a man's dress shirt having adjustable cuff and neck closures according to this invention.

Referring firstly to FIG. 1, reference numeral 10 generally identifies a garment, particularly a man's dress shirt having a pair of sleeves 12, 14, each terminating in cuffs 16, 18 encircling the wrists of a wearer during use; a pair of front panels 20, 22, one having a plurality of buttonholes and the other having a corresponding plurality of buttons 24, each being dimensioned to pass through a respective buttonhole to fasten the front panels together along an overlapping vertical marginal edge region; a pocket 26; a back panel 28; a neck band 30 encircling the neck of the wearer during use; and a collar 32 stitched to the neck band.

This invention relates to an adjustable closure for adjustably closing overlapping portions of a garment in a continuously variable manner. Virtually any garment will do. For each of illustration and description, but not for the purpose of limitation, this invention will be described in connection with an adjustable closure for the neck band 30 and/or for each cuff 16, 18 of the shirt 10.

Figure 3:
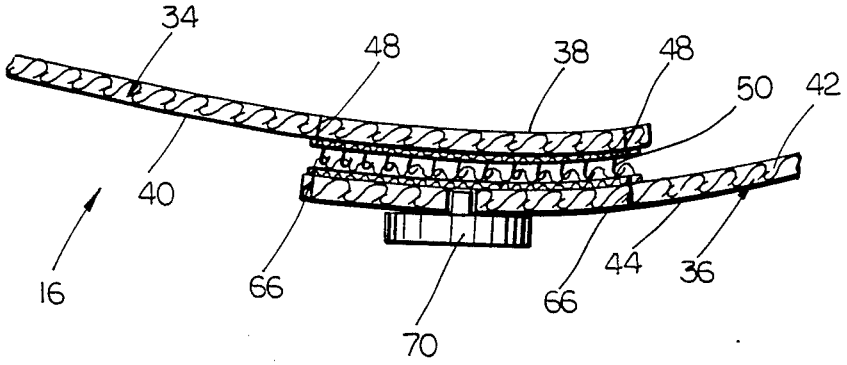
FIG. 3 is an enlarged sectional view taken on line 3—3 of FIG. 1 looking in the direction of the arrows.
Figure 4:
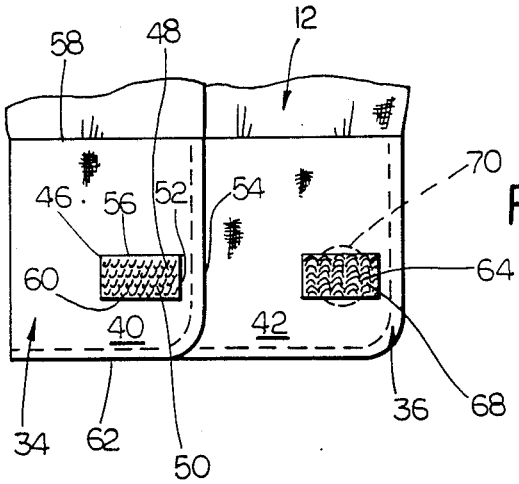
FIG. 4 is an enlarged view of an opened cuff having a cuff closure according to this invention.

Representative cuff 16, as shown in FIGS. 3 and 4, has an inner cuff portion 34 and an outer cuff portion 36. Inner cuff portion 34 has an interior face 38 and an exterior face 40. Outer cuff portion 36 has an interior face 42 and an exterior face 44.

A first soft, flexible fabric 46 of generally rectangular shape is sewn about its border by stitching 48 on the exterior face 40 of cuff portion 34. A fastening means 50, advantageously comprising a multitude of Velcro (trademark)-style hooks, is provided across the entire extent of fabric 46. As shown in FIG. 4, the rectangular fabric 46 is advantageously positioned so that its side edge 52 is located about 3/16" from side edge 54 of the cuff portion 34; its inner edge 56 is located about ⅞" from inner edge 58 of the cuff portion 34; and its outer edge 60 is located about 1" from outer edge 62 of the cuff portion 34.

A second soft, flexible fabric 64 of generally rectangular shape is sewn about its border by stitching 66 on the interior face of cuff portion 36. A complementary fastening means 68, advantageously comprising a multitude of Velcro (trademark)-style loops, is provided across the entire extent of fabric 64. The placement of the second fabric 64 relative to the side, inner and outer edges of cuff portions 36 is the same as that described above for first fabric 46.

As shown in FIG. 4, the inner 34 and outer 36 cuff portions do not overlap each other, thereby enabling the wearer to insert his hand past the cuff portions. Thereupon, the wearer presses the outer cuff portion 36 onto the inner cuff portion 34 so that the loops on fastening means 68 are hookingly engaged by the hooks on fastening means 50. The wearer selects the amount of overlap of the second fabric 64 on the first fabric 46. The amount of overlap is infinitely variable, and enables the wearer to accommodate his actual wrist size.

To open the cuff closure, the wearer peels the outer cuff portion away from the inner cuff portion, thereby disengaging the hooks from the loops.

A dress cuff button 70 is sewn on the exterior face 44 of outer cuff portion 36. The button 70 simulates the appearance of a conventional cuff closure button used for fastening cuff portions. However, the button 70 is a "fake" in the sense that it is not operative for fastening the outer and inner cuff portions together. That is the function of the aforementioned fastening means. The button 70 is strictly for ornamental purposes and, if desired to complete the illusion, a dress buttonhole 72 may be provided adjacent the button 70.

As for cuff 18, it is closed and opened in the same manner as that described for cuff 16 and, hence, will not be repeated for the sake of brevity.

Figure 2:
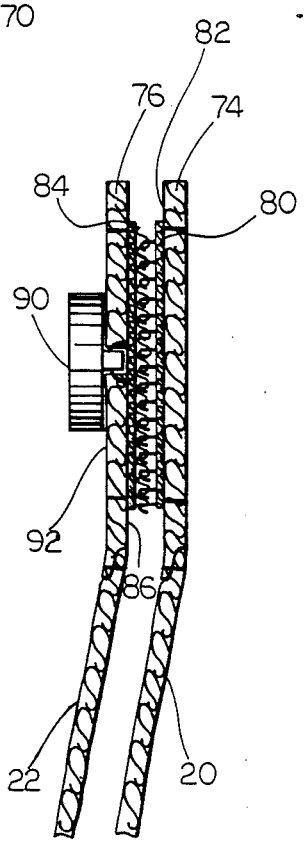
FIG. 2 is an enlarged sectional view taken on line 2—2 of FIG. 1 looking in the direction of the arrows.

In analogous manner, neck band 30 has overlapping inner 74 and outer 76 neck band portions. As shown in FIG. 2, a first soft, flexible fabric 80 having Velcro-style hooks is sewn on an outer face 82 of inner neck band portion 74; and a second soft, flexible fabric 84 having Velcro-style loops is sewn on an inner face 86 of outer neck band portion 76. The hooks and loops engage and are disengaged from each other as described previously. The fabrics 80, 84 extend all the way up to the side edges of the front panels 20, 22 and are centrally located between the upper and lower edges of the neck band, e.g. about 1/4" up from either the upper or the lower edge of the neck band.

Each fabric 46, 64, 80 and 84 has a length measuring about 1 ⅜" and a width measuring about ⅜".

Dress neck button 90 is sewn on an outer face 92 of outer neck band portion 76 and, just like button 70, does not function to close the neck band, but merely to serve as an ornamentation. A neck buttonhole may be formed adjacent the button 90 to complete the illusion that the button 90 is a conventional neck closure button.

Figure 5:
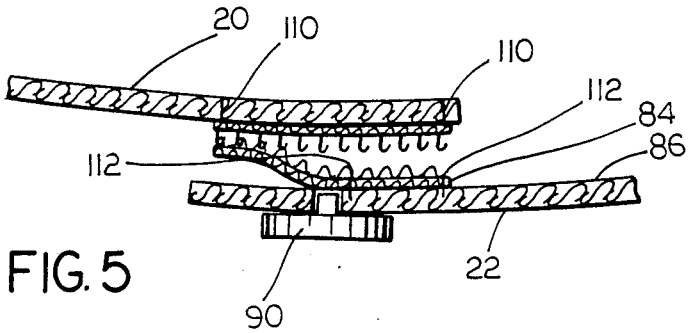
FIG. 5 is an enlarged sectional view, taken along line 5—5 of FIG. 1, illustrating a modified embodiment of the present invention.

In the embodiment described above, the fabrics 80 and 84 are sewn to the respective faces of the neck band portion along their entire lengths. However, FIG. 5 illustrates a modified embodiment of this arrangement. Thus, the fabric 80 with the hooks may be sewn along its length or at its ends by the threads 110. However, only approximately one-half of the loop fabric 84 is anchored to the inner face 86 by the threads 112; the leading half (i.e., the portion adjacent the edge of the shirt panel) being free to move. Accordingly, it has been found in practice that this arrangement permits the Velcro units to hold better.

It will be understood that each of the elements described above, or two or more together, also may find a useful application in other types of constructions differing from the types described above.

While the invention has been illustrated and described as embodied in adjustable neck and cuff closures for dress shirts, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. An adjustable closure for overlapping portions of a garment, comprising:

(A) closure means for continuously adjustably overlapping and fastening an outer garment portion over and to an inner garment portion, including (i) a first, flexible fabric sewn on an inner surface of the outer garment portion, and having first fastening means extending lengthwise along the first fabric, (ii) a second, flexible fabric sewn on an outer surface of the inner garment portion, and having second fastening means extending lengthwise along the second fabric, (iii) said first and second fastening means facing and engaging each other when the outer garment portion overlaps the inner garment portion to a desired variable extent selected by a wearer, and is pressed against the inner garment portion, and (iv) said first and second fastening means disengaging each other when the outer garment portion is peelably removed from the inner garment portion, and (b) a dress button sewn on an outer surface of the outer garment portion to simulate the appearance of a conventional garment closure button used for fastening outer and inner garment portions together, said dress button constituting no part of said closure means which is solely responsible for fastening the outer and inner garment portions together, at least one of said first or second fabric being sewn on said garment only over a portion of its length, whereby the remaining portion is free to move relative to said garment.

2. The closure as recited in claim 1, wherein the first fastening means constitutes a multitude of hooks, and wherein the second fastening means constitutes a multitude of loops, said hooks hookingly engaging the loops when the outer garment portion is pressed against the inner garment portion.

3. The closure as recited in claim 1, wherein the garment portions constitute a pair of neck band portions, and wherein the dress button is a neck button.

4. The closure as recited in claim 1, wherein the garment portions constitute two pairs of cuff portions, and wherein the dress button is a cuff button provided for each pair of cuff portions.

5. The closure as recited in claim 1, wherein the garment portions constitute a pair of neck band portions and two pairs of cuff portions, and wherein the dress button is provided for each pair of said neck band and cuff portions.

* * * * *